US008985189B2

(12) United States Patent
Eriksson et al.

(10) Patent No.: US 8,985,189 B2
(45) Date of Patent: Mar. 24, 2015

(54) ARRANGEMENT AND METHOD FOR FLOW CONTROL OF MOLTEN METAL IN A CONTINUOUS CASTING PROCESS

(71) Applicants: Jan-Erik Eriksson, Vasteras (SE); Hongliang Yang, Vasteras (SE); Boo Eriksson, Vasteras (SE)

(72) Inventors: Jan-Erik Eriksson, Vasteras (SE); Hongliang Yang, Vasteras (SE); Boo Eriksson, Vasteras (SE)

(73) Assignee: ABB AB (SE)

( * ) Notice: Subject to any disclaimer, the term of this patent is extended or adjusted under 35 U.S.C. 154(b) by 0 days.

(21) Appl. No.: 14/310,236

(22) Filed: Jun. 20, 2014

(65) Prior Publication Data

US 2014/0299288 A1 Oct. 9, 2014

Related U.S. Application Data

(63) Continuation of application No. PCT/EP2011/073727, filed on Dec. 22, 2011.

(51) Int. Cl.
*B22D 11/115* (2006.01)
*B22D 11/16* (2006.01)

(52) U.S. Cl.
CPC ..... *B22D 11/115* (2013.01); *B22D 11/16* (2013.01)
USPC ..... 164/466; 164/502; 164/468; 164/503; 164/504

(58) Field of Classification Search
CPC ..... B22D 11/115; B22D 11/116
USPC ..... 164/452, 466–468, 502–504
See application file for complete search history.

(56) References Cited

U.S. PATENT DOCUMENTS

| | | | | |
|---|---|---|---|---|
| 6,938,674 | B2 * | 9/2005 | Eriksson | 164/466 |
| 7,628,196 | B2 * | 12/2009 | Yamane et al. | 164/502 |
| 2005/0045303 | A1 * | 3/2005 | Itoyama et al. | 164/453 |
| 2010/0163207 | A1 | 7/2010 | Nikrityuk et al. | |

FOREIGN PATENT DOCUMENTS

| | | | |
|---|---|---|---|
| EP | 1510272 | A1 | 3/2005 |
| EP | 1623777 | A1 | 2/2006 |

(Continued)

OTHER PUBLICATIONS

Gardin, et al.; "Electromagnetic Casting of Slabs: Development of Numerical Models for an AC and DC Configuration in the Mould"; La Revue de Métallurgie-CIT Nov. 2001; pp. 1015-1024.
Dauby, et al.; "Electromagnetic Stirring in Slab Caster Molds: What and Why"; Nov. 2003; pp. 21-29.

(Continued)

*Primary Examiner* — Kevin E Yoon
(74) *Attorney, Agent, or Firm* — St. Onge Steward Johnston & Reens LLC

(57) ABSTRACT

An arrangement for a continuous casting process. The arrangement includes a vessel having a first opening for receiving molten metal in the vessel, a second opening for discharging the molten metal from the vessel, and a body extending between the first opening and the second opening, a first magnetic arrangement attached to the body, the first magnetic arrangement having a magnetic core with legs, and coils arranged around the legs, and a power system configured to provide an alternating current superimposed on a carrier current to each of the coils, each pair of alternating current and carrier current provided to a coil forming a flow control current, wherein flow control currents provided to adjacent coils are phase shifted relative each other, thereby creating a travelling magnetic field in molten metal in the vessel. A corresponding method is also presented herein.

13 Claims, 3 Drawing Sheets

(56) References Cited

FOREIGN PATENT DOCUMENTS

| | | | |
|---|---|---|---|
| JP | H05154623 | A | 6/1993 |
| JP | H10305353 | A | 11/1998 |
| WO | 2008004969 | A1 | 1/2008 |

OTHER PUBLICATIONS

International Preliminary Report on Patentability Application No. PCT/EP2011/073727 Completed: Feb. 7, 2014 19 pages.

International Search Report and Written Opinion of the International Searching Authority Application No. PCT/EP2011/073727 Completed: Jul. 13, 2012; Mailing Date: Jul. 25, 2012 13 pages.

Durand, et al.; "Le Brassage par Induction Appliquéà la Métallurgie D'élaboration et à la Solidification"; Jan. 1987; pp. 1-14.

Fujisaki, "Magnetohydrodynamic Stability in Pulse EMC"; 2002 IEEE pp. 508-514.

Schwerdtfeger K Ed—Schwerdtfeger K: "Metallurgie Des Stranggiessens, Passage", Jan. 1, 1991, Metallurgie Des Stranggiessens. Giessen Und Erstarren Von Stahl, Dusseldorf, Verlag Stahleisen De, pp. 449-531, XP002055225, paragraph [04.1].

Goffhelf D et al: "Mould Flow Monitoring—A Tool to Improve Caster Operation", Ist European Conference on Continuous Casting, Milano, IT, Oct. 20, 1998, pp. 825-833, XP008019065, paragraphs [introduction], [conclusion].

* cited by examiner

ARRANGEMENT AND METHOD FOR FLOW CONTROL OF MOLTEN METAL IN A CONTINUOUS CASTING PROCESS

FIELD OF THE INVENTION

The present disclosure generally relates to continuous casting of metals, an in particular to flow control of molten metal in a vessel of a continuous caster.

BACKGROUND OF THE INVENTION

In continuous casting of metals, scrap is melted in a furnace such as an electric arc furnace. The molten metal is typically tapped from the furnace to a ladle. The ladle is a vessel that may be a moveable, and which transports the molten metal to another vessel, a tundish, which acts as an intermediate storage vessel. From the tundish, the molten metal can be tapped into a mould.

FIG. 1 depicts a schematic cross-sectional side view of a vessel containing molten metal 3*a*. A primary flow 1*a*, generally having a flow direction in the casting direction, is created in the molten metal 3*a* contained in the vessel 5. Moreover, a secondary flow 1*b*, inter alia flowing towards the meniscus 3*b*, i.e. the surface of the molten metal 3*a*, is also created.

The primary flow and the secondary flow can be created in a vessel such as a mould for example due to vertical oscillation O of the vessel. The oscillations prevent solidified cast material to adhere to the inner mould walls. The movement in the molten metal causes bubbles and impurities in the melt to be transported in the casting direction. Therefore the molten metal is preferably controlled during the casting process, for instance by means of magnetic fields, such that the above-mentioned problems are reduced.

EP 1172158 discloses a method and an apparatus for continuous casting of metals. In this document, several coils are arranged at a casting mould such that the molten metal flow can be controlled properly. A plurality of coils are used for providing a static as well as a moving magnetic field in the melt.

EP1623777 discloses a continuous casting method for steel. At least three electromagnets are disposed along the longitudinal direction of a mould. While the electromagnets generate a vibrating magnetic field, peak positions of the vibrating magnetic field is shifted in the longitudinal direction of the mould.

JP10305353 discloses a process for continuous moulding of steel comprising arranging magnetic poles as upper and lower two stairs at the back face of a long side of a mould to place the long side of the mould between the upper and lower sides of a discharge hole of a dipping nozzle and controlling a flow of the molten steel in the mould by charging magnetic fields. The magnetic fields charged by the magnetic poles are made so as to be at least the magnetic field charged by the lower magnetic pole is a magnetic field superimposed by a direct current static magnetic field (DC-StMF); and an alternating current shifting magnetic field (AC-ShMF) or the magnetic fields charged by the upper magnetic pole is a magnetic field superimposed by the DC-StMF and the DC-ShMF and the magnetic field charged by the lower magnetic pole 8 is the DC-StMF.

JP5154623 discloses a method for controlling fluidity of molten steel in a mould. Three phase coils for electromagnetic stirring are arranged to the continuous casting mould and DC current periodically varying current value in conducted in each phase and the phase of variation of current value in each phase is shifted by 120 degree angle.

EP1510272 discloses a method for producing ultra low carbon steel slabs. An ultra-low carbon steel slab having a carbon content of about 0.01 mass percent or less is produced by casting at a casting speed of more than about 2.0 m/min using a mold provided with a casting space having a short side length D of about 150 to about 240 mm and an immersion nozzle provided with discharge spouts each having a lateral width d, the ratio D/d being in the range of from about 1.5 to about 3.0.

WO2008004969 discloses a method for controlling a flow of molten steel in a mould by applying at least one magnetic field to the molten steel in a continuous slab casting machine. This is achieved by comprising controlling a molten steel flow velocity on a molten steel bath surface, meniscus, to a predetermined molten steel flow velocity by applying a static magnetic field to impart a stabilizing and braking force to a discharge flow from an immersion nozzle when the molten steel flow velocity on the meniscus is higher than a mould powder entrainment critical flow velocity and by controlling the molten steel flow velocity on the meniscus to a range of from an inclusion adherence critical flow velocity or more to a mould powder entrainment critical flow velocity or less by applying a shifting magnetic field to increase the molten steel flow when the molten steel flow velocity on the meniscus is lower than the inclusion-adherence critical flow velocity.

Gardin P et al: "CC électromagnétique de brames: Développement de modéles numériques de la configuration AC+DC en longotiére/Electromagnetic casting of slabs: Development of numberical models for an AC & DC configuration in the mould" discloses a new concept of electromagnetic continuous casting of slabs, in which an alternating magnetic field (AC) with middle range frequency is combined with a continuous magnetic field (DC) in the vicinity of the mould meniscus.

SUMMARY OF THE INVENTION

A general object of the present disclosure is to provide an arrangement and a method which reduce at least one of the size and weight of an arrangement for a continuous casting process.

Moreover, it would be desirable to provide an arrangement at a lower price than in the prior art.

According to a first aspect of the present disclosure there is provided an arrangement for a continuous casting process, the arrangement comprising: a vessel having a first opening for receiving molten metal in the vessel, a second opening for discharging the molten metal from the vessel, and a body extending between the first opening and the second opening; a first magnetic arrangement attached to the body, the first magnetic arrangement having a magnetic core with legs, and coils arranged around the legs; and a power system configured to provide an alternating current and a carrier current, the alternating current being superimposed on the carrier current, to each of the coils, each pair of alternating current and carrier current provided to a coil forming a flow control current, wherein flow control currents provided to adjacent coils are phase shifted relative each other, thereby creating a travelling magnetic field in molten metal in the vessel.

By means of the above configuration of the power system, the first magnetic arrangement can become a hybrid electromagnet in the sense that the power system can deliver a suitable type of carrier current on which the alternating current is superimposed.

As will be described below with reference some specific embodiments, the carrier currents can be alternating currents or direct currents. Hence, by means of a single magnetic arrangement both AC and DC components can be provided simultaneously by each coil of the magnetic arrangement to control the molten metal flow in the vessel. Thus no dedicated DC electromagnet is required, as in the prior art where one AC fed and one DC fed electromagnet was arranged in level at the external mould surface.

According to one embodiment the first magnetic arrangement has a first magnetic part and a second magnetic part, the first magnetic part and the second magnetic part being arranged in level on opposite sides of the body. Thereby the magnetic fields can extend across a horizontal cross section of the vessel.

According to one embodiment the vessel has a first long side and a second long side opposite the first long side and distanced therefrom, wherein the first magnetic part is arranged along the first long side and the second magnetic part is arranged along the second long side.

According to one embodiment the vessel has a first side provided with the first opening, and wherein the legs of the first magnetic arrangement are arranged at an axial distance d from the first side, the distance d being greater than a distance to the meniscus level of molten metal when received in the vessel and less than or equal to a distance at which the molten metal is discharged into the vessel by a submerged entry nozzle. Turbulent flow of the secondary flow is mainly located in a volume of the molten metal in the vessel corresponding to this range or interval. Hence, the most efficient flow control of the secondary flow can be obtained in this range.

According to one embodiment the arrangement comprises a second magnetic arrangement arranged attached to the body, wherein the power system is arranged to feed the second magnetic arrangement with direct current. The second arrangement hence provides a static magnetic field to molten metal contained in the vessel. In particular, the second magnetic arrangement can provide an efficient braking force to the primary flow.

According to one embodiment the first magnetic arrangement is arranged upstream of the second magnetic arrangement with respect to a flow direction of the molten metal, the flow direction being defined from the first opening to the second opening. Thereby the secondary flow is primarily controlled by the first magnetic arrangement, and the primary flow is primarily controlled, by means of braking action, by the second magnetic arrangement.

According to one embodiment each carrier current is a direct current. Hence, each coil becomes a hybrid coil creating a static magnetic field and an alternating magnetic field, forming part of a travelling magnetic field, simultaneously.

According to one embodiment the power system is configured to provide carrier currents having mutually different polarity to at least two of the coils of the first magnetic part. Hence, field strengths can be controlled locally in as horizontal cross-section of the molten metal, especially in combination with the static magnetic field provided by the second magnetic arrangement.

According to one embodiment the power system is configured to provide carrier currents having the same polarity to each coil of the first magnetic part. Hence, field strengths can be controlled locally in the molten metal, especially in combination with the static magnetic field provided by the second magnetic arrangement.

According to one embodiment each carrier current is an alternating current. Hence, the alternating current is superimposed in an alternating current carrier current. This may be desirable in special situations for controlling the molten melt.

According to one embodiment the vessel is a casting mould. The vessel may however also be e.g. a ladle or a tundish.

In a second aspect of the present disclosure there is provided a method for flow control of molten metal in a vessel for a continuous casting process, the vessel having a first opening for receiving the molten metal, a second opening for discharging the molten metal and a body extending between the first opening and the second opening, wherein a first magnetic arrangement is attached to the body, the first magnetic arrangement having a magnetic core with legs, and coils arranged around the legs, the method comprising: providing an alternating current and a carrier current, the alternating current being superimposed on the carrier current, to each of the coils, each pair of alternating current and carrier current provided to a coil forming a flow control current, wherein flow control currents provided to adjacent coils are phase shifted relative each other, thereby creating a travelling magnetic field in the molten metal in the vessel.

One embodiment comprises measuring a parameter pertaining to the molten metal, and controlling the flow control currents based on the measured parameter. The flow control current, which controls the primary flow and the secondary flow is hence controlled based on the specific state of the molten metal in the vessel.

According to one embodiment the controlling comprises controlling any of a phase and amplitude of at least one flow control current.

According to one embodiment each carrier current is direct current.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. It is to be noted that, although the steps of the methods presented herein are referred to by numbers; a particular step may for instance be called "a first step", the steps of any method disclosed herein do not have to be performed in the exact order disclosed, unless explicitly stated.

BRIEF DESCRIPTION OF THE DRAWINGS

The specific embodiments of the inventive concept will now be described, by way of example, with reference to the accompanying drawings, in which.

DETAILED DESCRIPTION OF THE INVENTION

The inventive concept will now be described more fully hereinafter with reference to the accompanying drawings, in which exemplifying embodiments are shown. The inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description.

Figure 1:
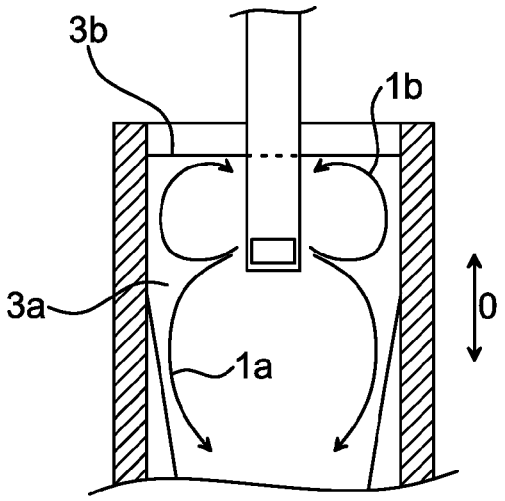
FIG. 1 shows a schematic view of molten metal flow directions in a casting mould.
Figure 2A:
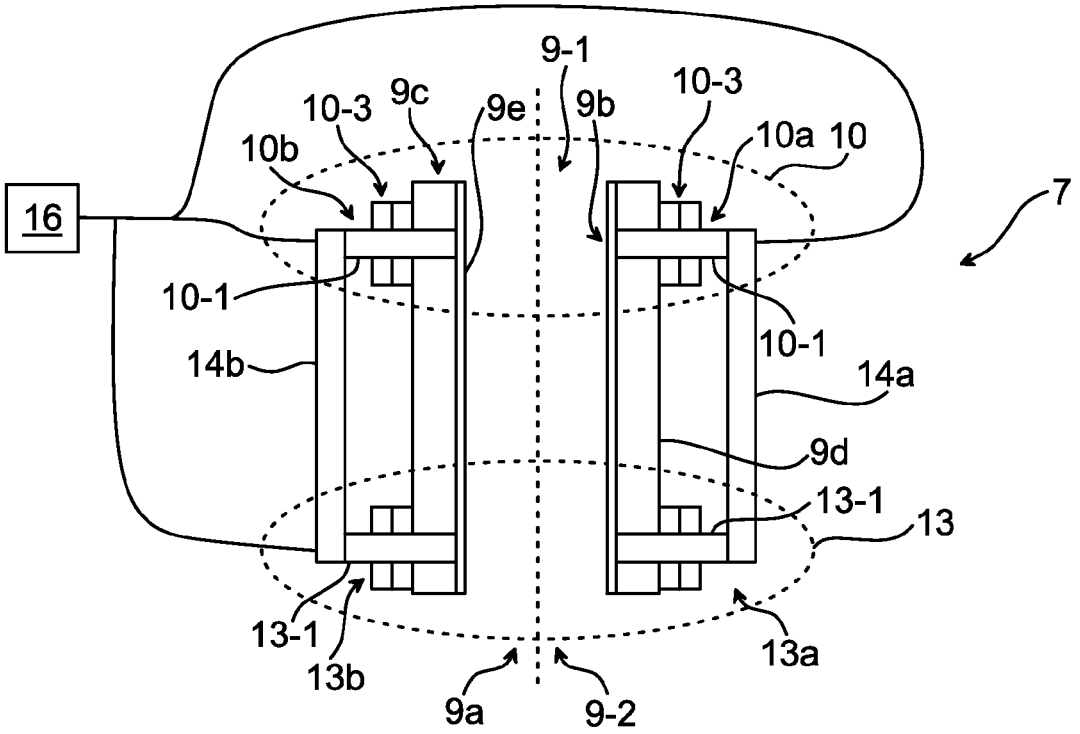
FIG. 2*a* shows a side view of an example of an arrangement for a continuous casting process.

FIG. 2*a* is a side view of an arrangement 7 for a continuous casting process for casting metal such as steel, copper or aluminium. The arrangement 7 comprises a vessel 9*a* having a body 9*b* provided with a first opening 9-1 and a second opening 9-2. The body 9*b* may have an external structure 9*c* presenting an external surface 9*d*, and an interior plate 9*e* for instance comprising copper. Molten metal is typically in contact with the interior plate 9*e* when the vessel 9*a* contains molten metal.

The vessel 9*a* in FIG. 2*a* depicts a casting mould for casting e.g. slabs or billets. It is however to be noted that the vessel may also be a ladle, a tundish or any other vessel utilised in a continuous casting process and through which molten metal may flow.

Figure 2B:
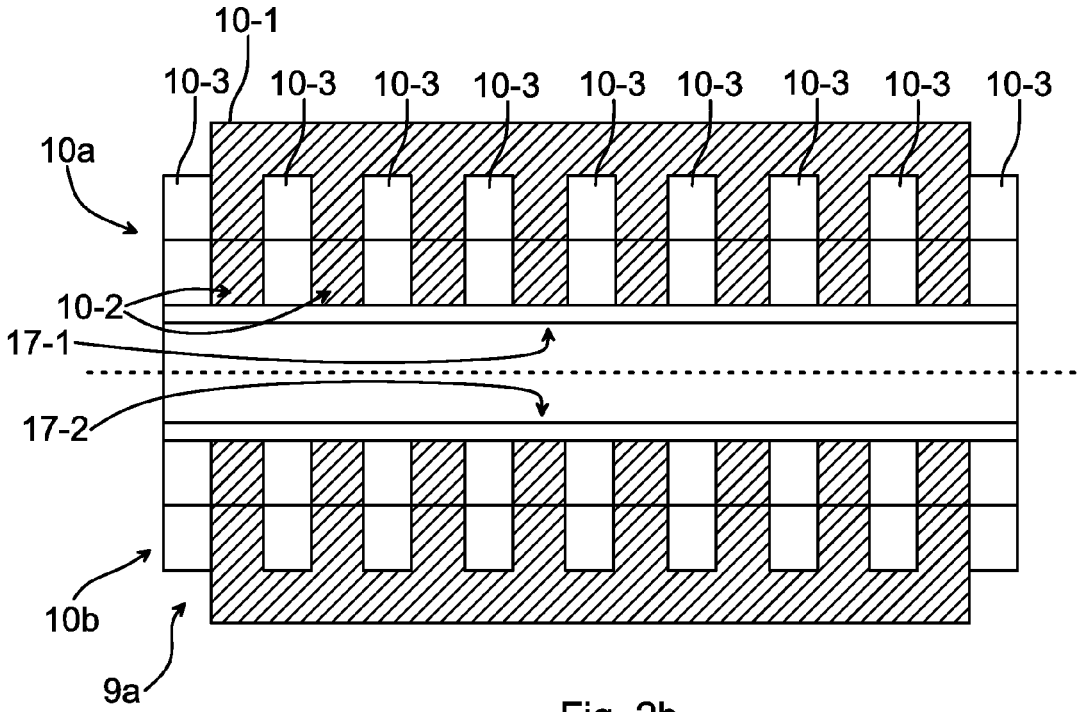
FIG. 2*b* shows a top view of the example in FIG. 2*a;*

The arrangement 7 further comprises a first magnetic arrangement 10 which has a first magnetic part 10*a* and a second magnetic part 10*b*. Each of the first magnetic part has a magnetic core 10-1 with legs 10-2, as shown in FIG. 2*b*, and coils 10-3. Each coil 10-3 is wound around a respective leg 10-2.

The first magnetic part 10*a* and the second magnetic part 10*b* of the first magnetic arrangement 10 are arranged in level on opposite sides of the body 9*b*. In use, the vessel 9*a* is generally arranged such that the first opening 9-1 and the second opening are openings in the vertical direction. Thus, molten metal is able to enter the vessel 9*a* via the first opening 9-1, to flow through the vessel 9*a*, and exit or being discharged from the vessel 9*a* via the second opening 9-2 by means of gravitational forces. In case of the vessel being a mould, the discharged portion is typically called a strand. Accordingly, in use, the first magnetic part 10*a* and the second magnetic part 10*b* are arranged at essentially the same vertical level of the body 9*b*.

In a preferred embodiment, the magnetic core 10-1 of the first magnetic part 10*a* and the second magnetic part 10*b* each consists of laminated iron cores. The magnetic cores 10-1 of the first magnetic part 10*a* and the second magnetic part 10*b* may be attached to the body 9*b*. In particular, the legs 10-2 of the magnetic cores 10-1 may in one embodiment abut the interior plates 9*e*.

The arrangement 7 may further comprise a second magnetic arrangement 13. The second magnetic arrangement 13 comprises a first magnetic part 13*a* and a second magnetic part 13*b*. Each of the first magnetic part 13*a* and the second magnetic part 13*b* of the second magnetic arrangement 13 comprises a magnetic core 13-1 provided with legs, and coils wound around the legs. The magnetic cores 13-1 are preferably solid iron cores, but may in one embodiment comprise laminated iron cores.

The first magnetic part 10*a* of the first magnetic arrangement 10 is in one embodiment magnetically connected to the first magnetic part 13*a* of the second magnetic arrangement 13 by means of a yoke 14*a*. The second magnetic part 10*b* of the first magnetic arrangement 10 is in one embodiment magnetically connected to the second magnetic part 13*b* of the second magnetic arrangement 13 by means of a yoke 14*b*. However, a plurality of different configurations are envisaged; instead of the above-described yoke configuration, the first magnetic part 10*a* and the second magnetic part 10*b* of the first magnetic arrangement 10 may be connected via a yoke. Accordingly, the first magnetic part 13*a* and the second magnetic part 13*b* of the second magnetic arrangement 13 may be connected via a yoke. Moreover, arrangements without yoke connections are also possible within the scope of the present disclosure.

The arrangement 7 further comprises a power system 16 arranged to feed the coils of the first magnetic arrangement 10 and the second magnetic arrangement 13 with current. It is to be noted that the power system may comprise separate power units, comprised within the same general power system, for instance for feeding the first magnetic arrangement and the second magnetic arrangement.

The power system 16 is configured to provide an alternating current superimposed on a carrier current to each of the coils of the first magnetic arrangement 10. The currents thereby formed and provided to each coil are herein called flow control currents. The flow control currents are phase shifted in such a way that flow control currents provided to any adjacent pair of coils are phase shifted relative each other. Hence, a travelling magnetic field can be obtained in the vessel 9*a*. The travelling magnetic field provides a stirring effect to molten metal in the vessel 9*a*. Thereby turbulence, primarily in the secondary flow, can be reduced in the molten metal.

According to one embodiment, the carrier currents provided to the coils 10-3 of the first magnetic arrangement 10 is direct current. Thereby each coil 10-3 of the first magnetic arrangement 10 acts as a hybrid coil providing a static magnetic field and a contribution to a travelling magnetic field simultaneously to molten metal in the vessel 9*a*.

According to one embodiment, the carrier currents provided to the coils 10-3 of the first magnetic arrangement 10 are alternating currents.

In one embodiment, the carrier currents may be a mix of direct currents and alternating currents, i.e. for some coils the carrier current is a direct current and for some coils the carrier current is an alternating current. Thereby complex flow control of the molten metal can be obtained.

The power system 16 may further be configured to provide direct current (DC) to each coil of the second magnetic arrangement 13. The direct current provided to the second magnetic arrangement 13 is a plain direct current, i.e. no other signals are superimposed thereon. The second magnetic arrangement 13 hence only produces a static magnetic field.

FIG. 2*b* is a top view of the arrangement in FIG. 2*a*. The vessel 9*a* has a first long side 17-1 and a second long side 17-2 opposite the first long side 17-1 and distanced therefrom. The first magnetic part 10*a* is arranged along the first long side 17-1 and the second magnetic part 10*b* is arranged along the second long side 17-2. In the present example, the first magnetic arrangement 10 has eight pairs of legs 11-2 and coils 11-3 in each of its first magnetic part 10*a* and second magnetic part 10*b*. The number of legs and coils typically depend on the width of the first long side and the second long side.

Figure 3:
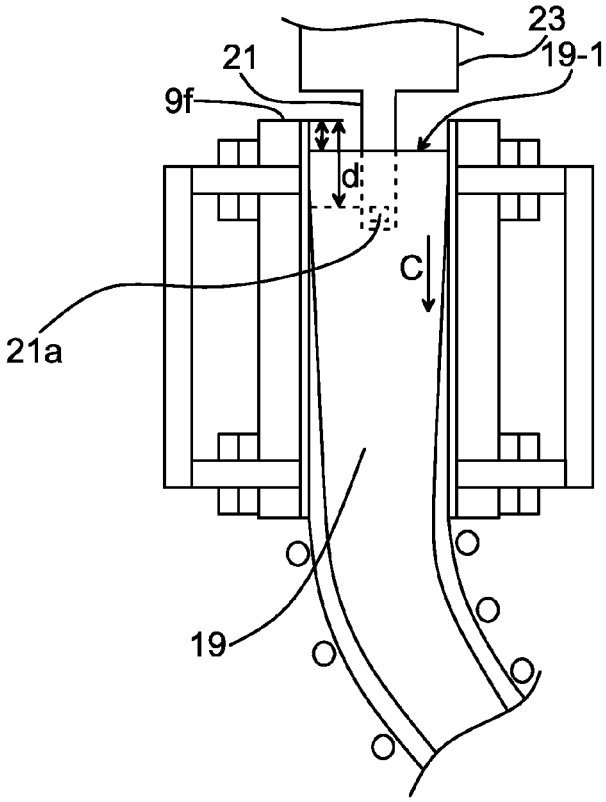
FIG. 3. shows a side view of an arrangement in use.

FIG. 3 is a schematic side view of the arrangement 7 during continuous casting. The vessel 9*a* is filled with molten metal 19. The molten metal 19 is discharged into the vessel 9*a* via a submerged entry nozzle (SEN) 21 of a tundish or ladle 23. The SEN 21 is hence submerged in the molten metal 19 in the vessel 9*a*. Molten metal 19 is discharged from the SEN 21 into the vessel 9*a* via discharge openings 21*a* of the SEN 21. The surface of the molten metal 19 is herein referred to as a meniscus 19-1.

The vessel 9*a* has a first side 9*f* provided with the first opening 9-1 for receiving the molten metal 19. Thus, when the vessel 9*a* is used, the first side 9*f* is typically an upper side of the vessel 9*a*.

According to one embodiment, the legs 10-2 of the first magnetic arrangement 10 are arranged at an axial distance d from the first side 9*f*. The legs 10-2 are preferably arranged orthogonal to the axial direction of the vessel 9*a*. In one embodiment the centre of the legs are arranged at the distance d from the first side 9*f*. The distance d is greater than a distance from the first side 9*f* to the meniscus 19-1 level of the molten metal 19 contained in the vessel 9*a*. The distance d is preferably less than or equal to a distance, from the first side 9*f*, at which the molten metal 19 is discharged into the vessel 9*a* by the SEN 21. The legs 10-2 may be arranged anywhere within this range to obtain efficient secondary flow in the molten metal 19 by means of the first magnetic arrangement 10. Thus, the legs are preferably arranged at a position radially outwards from where the submerged entry nozzle is submerged in the molten metal 19 in the vessel 9*a*.

The first magnetic arrangement 10 is arranged upstream of the second magnetic arrangement 13 with respect to a flow direction C of the molten metal 19, the flow direction being defined from the first opening 9-1 to the second opening 9-2.

Figure 4A:
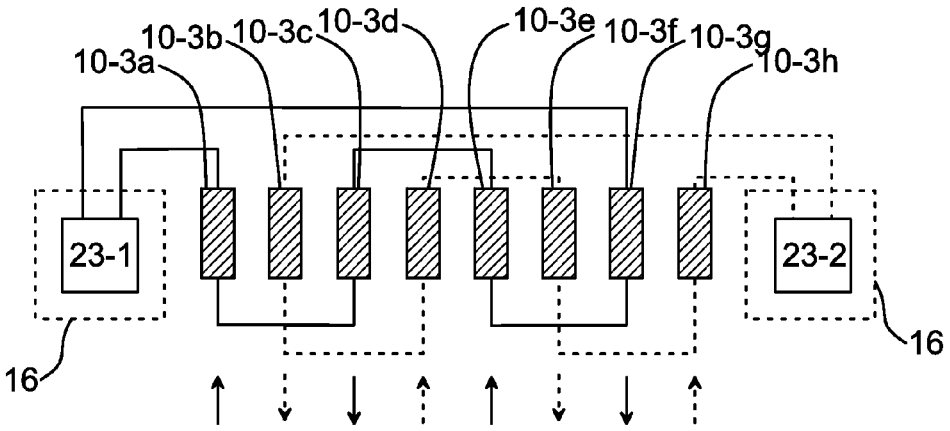
FIGS. 4 *a-b* shows power system configurations for the arrangement.
Figure 4B:
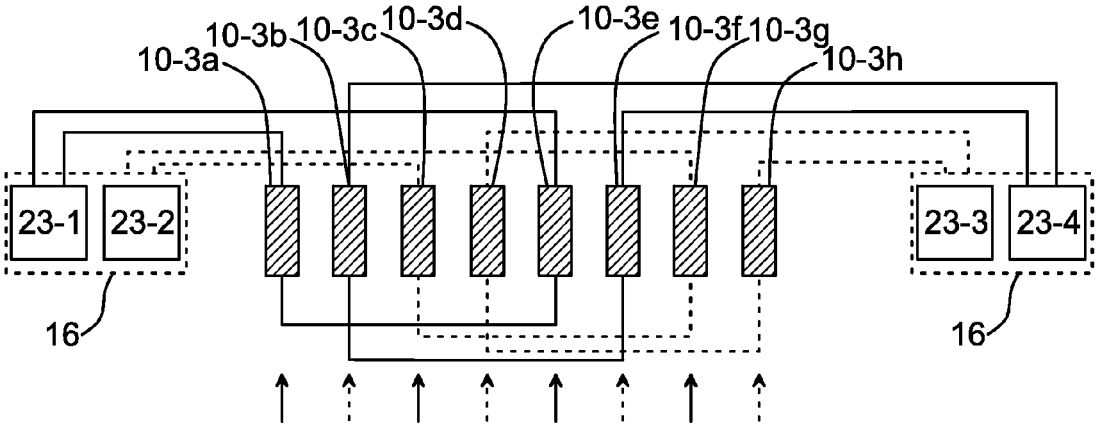

With reference to FIGS. 4*a* and 4*b*, schematic views of two examples of power source connection configurations of the coils 10-3 are shown. For simplicity, only the coils 10-3*a* to 10-3*h* of e.g. the first magnetic part, are shown in FIGS. 4*a-b*. According to the examples in FIGS. 4*a-b*, the magnetic core of the depicted magnetic part has 8 coils. However, a magnetic core according to the present disclosure may in different embodiments have any of for instance 6, 8, 9, 10, or 12 coils.

In FIG. 4*a*, the power system 16 has power converters 23-1 and 23-2 for providing alternating current superimposed on a carrier current to each of the coils 10-3*a* to 10-3*h*. The phase shift between adjacent coils may for instance be 45 or 90 degrees. Thus, according to one example, where the phase difference is 90 degrees between adjacent coils, coil 10-3*a* has 0 phase angle, coil 10-3*b* has 90 degrees phase angle, coil 10-3*c* has 180 degree phase angle, coil 10-3*d* has 270 degree phase angle, coil 10-3*e* has 0 degrees phase angle and so on. The arrows indicate the polarity of the carrier current, which in this example is direct current. In the example of FIG. 4*a*, adjacent coils are pairwise fed with direct current of the same polarity. Coil pairs are fed such that one is fed by the converter 23-1 and the other is fed by the converter 23-2. The end coils 10-3*a* and 10-3*h* have the same polarity. Hence, the power system 16 is configured to provide carrier currents having mutually different polarity to at least two of the coils of the first magnetic part.

It is to be noted that many variations of the polarities and phases of the carrier currents and the alternating currents, respectively, is possible within the scope provided by the claims.

In general, the specific alternating current and carrier current provided to a coil in a superimposed manner depends on the state of the molten metal in the vessel 9*a* and the flow rate of the molten metal provided by the casting pipe, e.g. the SEN 21. A control system with sensors and controllers is used for this purpose. The sensors may for instance be provided at the SEN 21 or at the interior walls of the vessel 9*a*. The sensors are arranged to measure one or more parameters pertaining to the molten metal, e.g. the temperature of the plates 9*e* of the vessel 9*a*, the flow rate of molten metal provided to the vessel or the meniscus level. The flow control currents are controlled based on the measured parameter or parameters. The flow control typically comprises controlling any of a phase and amplitude of at least one flow control current provided to the coils. In one embodiment any of the alternating current and the carrier current may be controlled individually for each coil.

In FIG. 4*b*, another power source configuration is shown. In this example, the power system 16 is configured to provide carrier currents having the same polarity to each coil 10-3*a* to 10-3*h* of the first magnetic part. In the particular example of FIG. 4*b*, four converters 23-1, 23-2, 23-3 and 23-4 are used for this purpose.

The inventive concept has mainly been described above with reference to a few embodiments. However, as is readily appreciated by a person skilled in the art, other embodiments than the ones disclosed above are equally possible within the scope of the invention, as defined by the appended claims.

What is claimed is:

1. An arrangement for a continuous casting process, the arrangement comprising:

a vessel having a first opening for receiving molten metal in the vessel, a second opening for discharging the molten metal from the vessel, and a body extending between the first opening and the second opening, a first magnetic arrangement attached to the body, the first magnetic arrangement having a magnetic core with legs, and coils arranged around the legs, a power system providing an alternating current and a carrier current, the alternating current being superimposed on the carrier current, to each of the coils, each pair of alternating current and carrier current provided to a coil forming a flow control current, wherein flow control currents provided to adjacent coils are phase shifted relative each other, thereby creating a travelling magnetic field in molten metal in the vessel, and a second magnetic arrangement attached to the body, wherein the power system is arranged to feed the second magnetic arrangement with direct current with no other signals superimposed thereon, wherein the first magnetic arrangement is arranged upstream of the second magnetic arrangement with respect to a flow direction of the molten metal, the flow direction being defined from the first opening to the second opening.

2. The arrangement as claimed in claim 1, wherein the first magnetic arrangement has a first magnetic part and a second magnetic part, the first magnetic part and the second magnetic part being arranged in level on opposite sides of the body.

3. The arrangement as claimed in claim 2, wherein the vessel has a first long side and a second long side opposite the first long side and distanced therefrom, wherein the first magnetic part is arranged along the first long side and the second magnetic part is arranged along the second long side.

4. The arrangement as claimed in claim 1, wherein the vessel has a first side provided with the first opening, and wherein the legs of the first magnetic arrangement are arranged at an axial distance d from the first side, the distance d being greater than a distance to the meniscus level of molten metal when received in the vessel and less than or equal to a distance at which the molten metal is discharged into the vessel by a submerged entry nozzle.

5. The arrangement as claimed in claim 1, wherein each carrier current is direct current.

6. The arrangement as claimed in claim 5, wherein the power system is configured to provide carrier currents having mutually different polarity to at least two of the coils of the first magnetic part.

7. The arrangement as claimed in claim 5, wherein the power system is configured to provide carrier currents having the same polarity to each coil of the first magnetic part.

8. The arrangement as claimed in claim 1, wherein each carrier current is an alternating current.

9. The arrangement as claimed in claim 1, wherein the vessel is a casting mould.

10. A method for flow control of molten metal in a vessel for a continuous casting process, the vessel having a first opening for receiving the molten metal, a second opening for discharging the molten metal and a body extending between the first opening and the second opening, wherein a first magnetic arrangement is attached to the body, the first magnetic arrangement having a magnetic core with legs, and coils arranged around the legs, a power system configured to provide an alternating current and a carrier current to each of the coils, a second magnetic arrangement attached to the body, wherein the power system is arranged to feed the second magnetic arrangement with direct current with no other signals superimposed thereon, and wherein the first magnetic arrangement is arranged upstream of the second magnetic arrangement with respect to a flow direction of the molten metal, the flow direction being defined from the first opening to the second opening, the method comprising:

providing, with the power system, an alternating current and a carrier current, the alternating current being superimposed on the carrier current, to each coil of the first magnetic arrangement, each pair of alternating current and carrier current provided to a coil forming a flow control current, wherein flow control currents provided to adjacent coils are phase shifted relative each other, thereby creating a travelling magnetic field in the molten metal in the vessel.

11. The method as claimed in claim 10, comprising measuring a parameter pertaining to the molten metal, and controlling the flow control currents based on the measured parameter.

12. The method as claimed in claim 11, wherein the controlling comprises controlling any of a phase and amplitude of at least one flow control current.

13. The method as claimed in claim 10, wherein each carrier current is direct current.

* * * * *